US010478847B2

(12) United States Patent
Krumma et al.

(10) Patent No.: US 10,478,847 B2
(45) Date of Patent: Nov. 19, 2019

(54) COATING SYSTEM AND ASSOCIATED OPERATING METHOD

(71) Applicant: Dürr Systems AG, Bietigheim-Bissingen (DE)

(72) Inventors: Harry Krumma, Bönnigheim (DE); Benjamin Wöhr, Eibensbach/Güglingen (DE); Frank Herre, Oberriexingen (DE); Detlev Hannig, Winterbach (DE); Alexander Meissner, Stuttgart (DE); Andreas Federmann, Stuttgart (DE); Pascal Spathelf, Illingen (DE); Michael Lauer, Stuttgart (DE); Robert Baumeister, Löchgau (DE); Martin Weidle, Gerlingen (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 0 days.

(21) Appl. No.: 15/575,915

(22) PCT Filed: May 20, 2016

(86) PCT No.: PCT/EP2016/000845
§ 371 (c)(1),
(2) Date: Nov. 21, 2017

(87) PCT Pub. No.: WO2016/188626
PCT Pub. Date: Dec. 1, 2016

(65) Prior Publication Data

US 2018/0147591 A1 May 31, 2018

(30) Foreign Application Priority Data

May 22, 2015 (DE) ..... 10 2015 006 666
Aug. 4, 2015 (DE) ..... 10 2015 009 885

(51) Int. Cl.
*B05B 14/40* (2018.01)
*B05B 15/555* (2018.01)
(Continued)

(52) U.S. Cl.
CPC ..... *B05B 14/40* (2018.02); *B05B 12/18* (2018.02); *B05B 13/0431* (2013.01);
(Continued)

(58) Field of Classification Search
USPC ..... 118/308, 309, 326, 634, 50, 324, 62, 63, 118/602, 323, 321
See application file for complete search history.

(56) References Cited

U.S. PATENT DOCUMENTS 4,898,116 A * 2/1990 Kozoe ..... B05B 14/20 118/621
5,178,679 A * 1/1993 Josefsson ..... B05B 16/95 118/309
(Continued)

FOREIGN PATENT DOCUMENTS

DE 10209489 A1 10/2003
DE 10 2007 048248 A1 5/2009
(Continued)

OTHER PUBLICATIONS

International Search Report and Written Opinion for PCT/EP2016/000845 dated Nov. 14, 2016 (26 pages; with English translation).

*Primary Examiner* — Yewebdar T Tadesse
(74) *Attorney, Agent, or Firm* — Bejin Bieneman PLC

(57) ABSTRACT

The disclosure relates to an operating method for a coating system, in particular for a painting system, for coating components (2), in particular motor vehicle body components (2), having the following steps:

conveying, by means of a conveying device (3), the components (2) to be coated in a conveying direction through a coating booth (1), (Continued)

coating the components (2) in the coating booth (1) with a coating product by means of an application device (17-19) which applies a spray jet of the coating product, a portion of the applied coating product being deposited on the components (2) to be coated while another portion of the applied coating product floats into the interior of the coating booth (1) as an excess coating product mist (21), and reducing the excess coating product mist (21) from the interior of the booth by means in addition to or other than the downwardly directed air flow generated by a filter ceiling. In addition, the disclosure includes a correspondingly designed coating system.

23 Claims, 10 Drawing Sheets

(51) Int. Cl.

| | |
|---|---|
| ***B05B 16/00*** | (2018.01) |
| ***B05C 15/00*** | (2006.01) |
| ***B05B 12/18*** | (2018.01) |
| ***B05B 13/04*** | (2006.01) |
| ***B05B 14/46*** | (2018.01) |
| *B05B 14/48* | (2018.01) |
| *B05B 14/468* | (2018.01) |
| *B05B 12/14* | (2006.01) |

(52) U.S. Cl.

CPC ..... *B05B 13/0452* (2013.01); *B05B 14/469* (2018.02); *B05B 15/555* (2018.02); *B05B 16/90* (2018.02); *B05B 16/95* (2018.02); *B05C 15/00* (2013.01); *B05B 12/1472* (2013.01); *B05B 14/468* (2018.02); *B05B 14/48* (2018.02)

(56) References Cited

U.S. PATENT DOCUMENTS

| | | | | |
|---|---|---|---|---|
| 5,279,631 | A * | 1/1994 | Pingel | B05B 14/43 55/294 |
| 5,680,670 | A * | 10/1997 | Adams | B05B 14/41 15/302 |
| 5,681,390 | A * | 10/1997 | Lacchia | B05B 14/41 118/326 |
| 6,997,991 | B2 * | 2/2006 | von Keudell | B05B 14/41 118/326 |
| 7,172,138 | B2 * | 2/2007 | Mather | B05B 13/0405 239/106 |
| 2003/0136338 | A1 | 7/2003 | Pohl et al. | |
| 2003/0192472 | A1 | 10/2003 | Hihn et al. | |
| 2005/0000419 | A1 | 1/2005 | Keudell et al. | |
| 2011/0045194 | A1 | 2/2011 | Herre et al. | |
| 2011/0262622 | A1 | 10/2011 | Herre et al. | |

FOREIGN PATENT DOCUMENTS

| | | | |
|---|---|---|---|
| DE | 20 2009 006290 | U1 | 10/2009 |
| DE | 102008022885 | A1 | 11/2009 |
| DE | 10 2008 053 178 | A1 | 5/2010 |
| DE | 10 2011 122 056 | A1 | 6/2013 |
| EP | 1466670 | A2 | 10/2004 |
| GB | 2160639 | A | 12/1985 |
| WO | 02/078858 | A1 | 10/2002 |

* cited by examiner

COATING SYSTEM AND ASSOCIATED OPERATING METHOD

CROSS-REFERENCE TO RELATED APPLICATIONS

This application is a national stage of, and claims priority to, Patent Cooperation Treaty Application No. PCT/EP2016/000845, filed on May 20, 2016, which application claims priority to German Application No. DE 10 2015 006 666.8, filed on May 22, 2015 and German Application No. DE 10 2015 009 855.1, filed on Aug. 4, 2015, which applications are hereby incorporated herein by reference in their entireties.

The disclosure relates to a coating method for a coating system, in particular for a painting system for painting motor vehicle body components. The disclosure further includes a corresponding coating system.

In modern painting systems for painting motor vehicle body components, the motor vehicle body components to be painted are conventionally conveyed by a conveyor along a painting line through a plurality of successive painting booths in which the various paint layers (e.g. base coat, clear coat) are applied.

Application of the paint to be applied is generally carried out by rotary atomisers, which are guided in a highly movable manner by multi-axis painting robots. During application of the paint by the rotary atomisers, a large part of the applied paint is deposited on the motor vehicle body component to be painted, where it forms the desired paint layer. However, a portion of the applied paint initially remains in the booth interior of the painting booth as overspray, this overspray being troublesome.

In order to reduce the overspray from the painting booth, the ceiling of the painting booth is conventionally in the form of a so-called filter ceiling, which generates in the booth interior as a whole a downwardly directed flow which is as laminar as possible. This downwardly directed air flow in the booth interior pushes the overspray downwards through the booth floor, which is in the form of a grid, into a washing system, which can be in the form of a dry-scrubbing system or a wet-washing system and washes out the coating agent contained in the overspray.

A particular problem, however, is the reduction of the overspray that forms in the interior of the motor vehicle body components that are to be painted as a result of the internal painting of internal surfaces of the motor vehicle body components. The downwardly directed air flow generated by the filter ceiling is hereby shielded by the roof of the motor vehicle body components and can therefore remain in the interior of the motor vehicle body components that are to be painted for a relatively long time despite the downwardly directed air flow. When the painted motor vehicle body components are subsequently discharged from the painting booth, the overspray can then escape from the interior of the motor vehicle body components and interfere with the next painting operation if the overspray cannot be reduced quickly enough.

This problem exists in particular when the motor vehicle body components are conveyed along the painting line not continuously but in stop-and-go operation, because relatively high accelerations of the motor vehicle body components then occur as they are discharged from the painting booth. These relatively high accelerations of the motor vehicle body components as they are discharged from the painting booth result in air turbulence, so that the overspray can remain in the booth interior of the painting booth for a relatively long time after escaping from the interior of the motor vehicle body components which have been discharged.

A further disadvantage of filter ceilings results from the fact that the downwardly directed air flow must pass through a filter in the filter ceiling, which offers a flow resistance to the downwardly directed air flow and thereby limits the flow speeds. The filter ceiling thus permits only relatively low flow speeds of the downwardly directed air flow, so that the reduction of the overspray is unsatisfactory.

In relation to the prior art discussed above concerning painting booths having a filter ceiling for reducing the overspray, reference is also to be made to DE 102 09 489 A1, DE 10 2008 053 178 A1 and DE 10 2011 122 056 A1. However, these publications merely disclose painting booths in which the overspray is reduced only by the downwardly directed air flow which emerges from the filter ceiling or is extracted by suction via the filter ceiling. This is associated with the disadvantages described above.

A need has arisen to improve overspray reduction.

DETAILED DESCRIPTION

Figure 1:
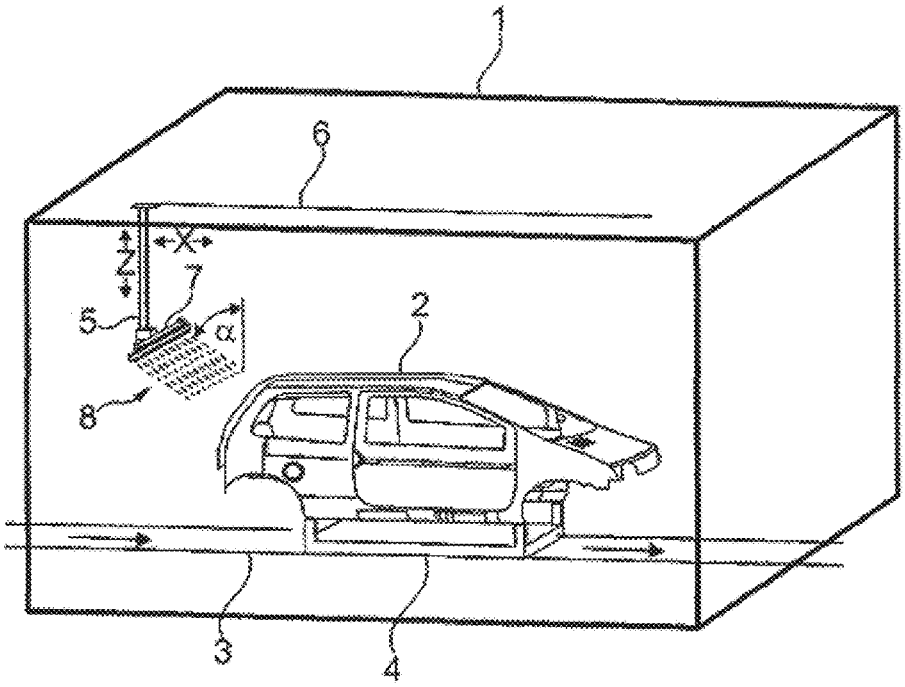
FIG. 1 is a simplified perspective view of a painting system having an additional robot for reducing overspray.

The disclosure herein is based on the technical-physical finding, already mentioned briefly above, that the overspray initially remains in the coating booth, and must therefore be reduced, in particular owing to two phenomena.

Firstly, this is assisted by the following properties of modern painting systems for painting motor vehicle body components:

The motor vehicle body components to be painted are discharged from the painting booth more quickly compared to older painting systems and are thereby accelerated more greatly, which leads to more pronounced turbulence of the overspray.

The air falling speed in the painting booth is lower in modern painting systems than in older painting systems.

In modern painting systems, the paint is applied with larger output quantities and higher discharge rates, which permits a higher surface coating efficiency but also results in more overspray.

In modern painting systems, the individual painting booths are shorter and narrower than previously, which reduces the energy consumption but also exacerbates the overspray problem.

In modern painting systems, more robots and more atomisers are arranged in the individual painting booths, which likewise exacerbates the overspray problem.

Secondly, however, the overspray in the coating booth is also assisted by internal painting, whereby the paint is applied in the interior of a motor vehicle body. When a motor vehicle body is discharged from the painting booth, the inertia pushes the overspray out of the motor vehicle body through the rear window. In addition, the airstream generated as a motor vehicle body is discharged also pushes the overspray out of the motor vehicle body through the rear window.

The two phenomena described above can have the result that the overspray from the last painted motor vehicle body can be deposited on the next motor vehicle body, which can lead to problems with quality.

The disclosure therefore provides that the overspray in a coating booth is not or at least not only reduced by the known downwardly directed air flow generated by the conventional filter ceiling. Instead, the disclosure provides that the overspray in the coating booth is reduced by a separate downwardly directed air flow which is not generated by the filter ceiling.

In a first embodiment of the disclosure, this separate air flow is spatially limited and does not extend over the entire booth interior.

This separate air flow is preferably not oriented exactly vertically from top to bottom but is angled in the conveying direction, for example at an angle of 5°-60°, 10°-55° or 15°-45° to the vertical. This angling of the downwardly directed air flow is advantageous because a portion of the overspray is then also reduced in the direction towards the booth exit, so that the region of the booth interior close to the booth entrance is cleaned more quickly.

This oblique angling of the air flow in the conveying direction relative to the vertical is also possible within the scope of the disclosure in the case of the downwardly directed air flow generated by the filter ceiling. The disclosure therefore also includes a variant in which the downwardly directed air flow from the filter ceiling is angled in the conveying direction without an additional air flow for reducing the overspray being generated. However, the downwardly directed air flow may be generated by bypassing the filter ceiling, so that the maximum achievable flow speed is not limited by the flow resistance of the filter in the filter ceiling.

Alternatively or in addition, the downwardly directed air flow is generated by an additional flow device, for example by a movable manipulator.

In the first embodiment of the disclosure, the separate air flow for reducing the overspray is generated by a movable manipulator having a plurality of movement axes, which is movably arranged in the booth interior. This manipulator for reducing the overspray is preferably a multi-axis robot with serial or parallel robot kinematics.

In a further embodiment, the movable manipulator has a single movement axis.

In a variant of the disclosure, this manipulator reduces the overspray from the booth interior by blowing air into the booth interior, the air that is blown in hitting the overspray and reducing it from the booth interior or at least accelerating the reduction of the overspray.

In another variant of the disclosure which is likewise possible, on the other hand, the manipulator reduces the overspray from the booth interior by extracting the overspray by suction.

Within the scope of the disclosure, the manipulator for reducing the overspray can be fixedly arranged inside the coating booth.

However, it is also possible, as an alternative, for the manipulator for reducing the overspray to be displaceable in the conveying direction along a displacement rail. This provides the possibility that, as a component is discharged from the coating booth, the manipulator for reducing the overspray follows the discharged component in order to reduce as quickly as possible the overspray that escapes from the interior of the component as the component is discharged.

With regard to the mounting of the manipulator for reducing the overspray, there are various possibilities within the scope of the disclosure.

For example, the manipulator can be suspended from a ceiling of the coating booth and can then deliver the air stream for reducing the overspray downwards into the coating booth. This suspended mounting of the manipulator from the ceiling of the coating booth reduces the susceptibility to contamination because there is scarcely any or only a low density of overspray close to the ceiling.

Alternatively, it is possible that the manipulator for reducing the overspray is mounted laterally on the coating booth, either standing on the booth floor or suspended from the side walls.

There are also various possibilities as regards the type of manipulator for reducing the coating agent.

In an embodiment of the disclosure, the manipulator is an articulated robot with serial robot kinematics and a plurality of non-parallel pivot axes, such articulated robots being sufficiently well known from the prior art and also being used in conventional painting systems, for example, as application robots or handling robots (e.g. bonnet openers, door openers).

However, it is also possible as an alternative that the manipulator for reducing the overspray is a so-called SCARA robot (SCARA: selective compliance assembly robot arm), such SCARA robots being known per se from the prior art and being used, for example, as door openers in painting systems for painting motor vehicle body components. A feature of such SCARA robots is that the pivot axes of the various robot elements are oriented parallel to one another and typically extend vertically.

In theory, it is of course also possible within the scope of the disclosure that the manipulator for reducing the overspray is a robot with parallel kinematics.

In one example of the disclosure, however, the manipulator for reducing the overspray is a multi-axis application robot which also guides the applicator (e.g. rotary atomiser)

for applying the coating agent. The application robot thus has several functions. On the one hand, the application robot guides the applicator (e.g. rotary atomiser) over the surface of the components to be coated in order to apply coating agent. On the other hand, however, the application robot also serves to reduce the overspray from the booth interior of the coating booth.

For example, for that purpose the applicator can blow out shaping air, which is normally used to shape the spray jet and is then purposively used to reduce the overspray from the coating booth. In normal application operation, the shaping air is thus used to shape the spray jet. However, the shaping air can additionally also be used to blow away and thereby reduce the overspray, coating agent naturally not being applied in this mode of operation.

Alternatively, it is possible that the application robot has, in addition to or instead of the shaping air nozzle or nozzles, a separate air nozzle which serves only for reducing the overspray.

It is further possible within the scope of the disclosure that the manipulator for reducing the overspray is a handling robot, for example a door opener or a bonnet opener, which is used in a painting system for painting motor vehicle body components for opening doors or engine bonnets or boot lids for subsequent internal painting.

Finally, it is of course also possible that the manipulator for reducing the overspray is provided for that purpose and serves neither to apply the coating agent nor to handle the components to be coated, which allows the design of the manipulator to be optimised for the purpose of reducing the overspray.

It has already been mentioned above that the overspray can be reduced from the booth interior in that air can be blown in by the manipulator, for which purpose the manipulator (e.g. application robot, handling robot or separate robot) can guide an air nozzle. In a preferred embodiment of the disclosure, the manipulator has a proximal robot arm and a distal robot arm which is pivotable relative thereto, it being possible for the air nozzle for reducing the overspray to be mounted on the proximal robot arm and/or on the distal robot arm. The air nozzle for reducing the overspray is, however, preferably located on the distal robot arm.

In order to achieve a higher cleaning action when reducing the overspray there may be provided a large number of air nozzles which can be arranged in a line one behind the other in the form of a nozzle strip. This nozzle strip is preferably arranged on the distal robot arm and extends in the longitudinal direction of the distal robot arm. However, it is also possible, as an alternative, for the nozzle strip to be arranged at the end of the manipulator and always to be oriented at a right angle to the conveying direction and horizontally.

It has already been mentioned at the beginning that overspray can escape from the interior of the coated component when the coated components are discharged from the coating booth, which can lead to the following coating operation being impaired. This overspray is then initially located in the region of the coating position inside the coating booth, that is to say in the region in which the component was previously coated. In the region of the booth entrance, on the other hand, there is less overspray, so that the next component can be coated in that region close to the booth entrance even if the booth interior in the region of the final coating position is still contaminated with the overspray.

In a variant of the disclosure it is therefore provided that, when the components to be coated are conveyed into the coating booth, they are not immediately conveyed to their final coating position but are first conveyed to a preliminary position, which is located upstream of the final coating position in the conveying direction. For example, the motor vehicle body components to be painted can project in the preliminary position with their front region into the painting booth, so that the front region (e.g. engine bonnet, front wing) can be painted in that preliminary position while the overspray at the final coating position inside the painting booth is still being reduced. The components are then conveyed from the preliminary position into the final coating position when the overspray in the region of the final coating position has been reduced and the component in the preliminary position has been coated in the front region. In the final coating position, the remaining surface regions (e.g. boot lid, roof, doors, rear wing) outside the front region are then also coated.

It has already been mentioned above that, when a component is discharged from the coating booth, overspray can escape from the component or can be stirred up by the component as it is discharged, which makes reduction of the overspray from the booth interior more difficult. The reduction of the overspray provided within the scope of the disclosure is therefore spatially concentrated in a cleaning region, the cleaning region not including the entire booth interior but being limited to the region of the component that is discharged, where the overspray escapes from the component and turbulence is generated. For example, the cleaning region can also be limited to the region of the booth interior that is situated slightly behind the component relative to the conveying direction because, as a component is discharged, the overspray escapes from the component backwards, so that the overspray must also be reduced from that region. It is possible that, as the component is discharged, the cleaning region is moved synchronously with the discharged component in order to optimise the reduction of the escaping overspray. The coating system according to the disclosure therefore preferably has a control device which synchronises the movements of the conveyor and of the cleaning region with one another. The control device thus may also control the movement of the manipulator which reduces the overspray.

The disclosure is particularly advantageous when the components to be coated are conveyed through the coating booth in stop-and-go operation, because the components are then accelerated and braked as they are conveyed into and discharged from the coating booth, so that turbulence is generated, which impedes the reduction of the overspray by the downwardly directed air flow from a conventional filter ceiling. The disclosure, in conjunction with correspondingly rapid conveying technology, permits a conveying time of less than 13 seconds, 11 seconds or less than 9 seconds, the conveying time in the case of stop-and-go operation being the time period from one stoppage of a component to the next stoppage of the same component.

In addition, it is advantageous, in the alternate, if the components to be coated are first accelerated with relatively low acceleration as they are discharged from the coating booth, which is compensated for by greater deceleration upon braking. The relatively low acceleration during discharge is advantageous because less turbulence, which holds the overspray in the booth interior for longer, is then generated. In addition, the relatively slow acceleration during discharge from the coating booth is also advantageous, however, because the overspray located in the interior of the respective component then does not escape or does not escape completely from the component to the outside.

It should further be mentioned that the disclosure not only relates to protection for an operating method according to the disclosure for a coating system. Rather, the disclosure also relates to protection for a correspondingly designed coating system, the details of the operating method and of the coating system being apparent from the preceding description.

It should also be mentioned that the disclosure is not limited as regards the component to be coated to motor vehicle body components. Rather, the components to be coated can be any desired components, such as, for example, rotor blades of wind power plants or parts (e.g. rotor blade half-shells) thereof or aircraft parts (e.g. wings, tail unit parts, fuselage parts, etc.).

In addition, the disclosure is not limited as regards the applied coating agent to paints (e.g. base coat, clear coat) or specific paint types (e.g. wet paint, powder paint). Rather, the coating agent can be any desired coating agent, the application of which produces a overspray.

It has already been mentioned above that the overspray is reduced from the booth interior of the coating booth by a downwardly directed air flow. This downwardly directed air flow can also be generated, for example, by a blowing nozzle arrangement which delivers the air flow downwards through at least one blowing nozzle in order to blow the overspray away downwards. This blowing nozzle arrangement is preferably arranged above the conveyor and also above the components to be coated, for example on a booth ceiling or on a gantry which spans the conveying path. The blowing nozzle arrangement may extend through the coating booth transversely to the conveying direction and may be movable in the conveying direction. This means that the blowing nozzle arrangement can be moved forwards and backwards in the conveying direction. The movable blowing nozzle arrangement can be driven by a cable drive, for example.

In a variant of the disclosure, this blowing nozzle arrangement is pivotable about an axis of rotation transversely to the conveying direction. The blowing nozzles may thereby be at a distance from the axis of rotation so that, when the blowing nozzle arrangement performs a pivot movement, the blowing nozzles execute a curved movement in a vertical plane parallel to the conveying direction. The blowing nozzle arrangement may ensure that the blowing nozzles are held in a constant angular orientation relative to the vertical when they perform a pivot movement. The blowing nozzles thus may remain oriented vertically downwards, so that the air flow is delivered vertically downwards. For example, the blowing nozzle arrangement can have a pivotable frame which is pivotable about the above-mentioned axis of rotation. The axis of rotation preferably extends through one edge of the frame, while the blowing nozzles are mounted on the opposite edge of the frame.

However, it is also possible, as an alternative, that the blowing nozzle arrangement has a linear displacement axis which extends parallel to the conveying direction, so that the blowing nozzles are displaceable in the conveying direction. Here too, a cable drive can be provided for driving the blowing nozzle arrangement.

The blowing nozzles can thus perform either a pivoting movement or a linear movement. However, it is also possible within the disclosure that the blowing nozzles perform a combined movement which consists of a pivoting movement and a superposed linear movement.

The disclosure may further provide a control unit which controls the downwardly directed air flow, whereby in particular the flow speed, the mass flow (e.g. volume flow) and/or the direction of flow can be controlled.

For example, the control unit can switch off or at least decrease the air flow during a painting operation. During the breaks in painting, the control unit can then switch on or increase the air flow.

It is thereby also possible to distinguish between the downwardly directed air flow from the filter ceiling (plenum) and the downwardly directed air flow that is generated in addition thereto. The downwardly directed air flow from the filter ceiling can then also remain switched on during a painting operation, whereas the additional air flow can then be switched off or at least decreased. In the breaks in painting, both the downwardly directed air flow from the filter ceiling and the additional air flow can then be switched on undiminished.

In addition, it may be ensured that no undesired air flows occur in the painting booth as a result of the downwardly directed air flow, and that too much air is not introduced into the painting booth. It should be taken into consideration that the downwardly directed air flow that has the purpose of reducing the overspray from the painting booth is generally generated in a break in painting. During a painting operation, this air flow is generally switched off. Instead, air is then introduced into the painting booth via the filter ceiling as well as via the atomiser air (e.g. driving air, braking air, shaping air and bearing air) which is delivered by the atomiser. The downwardly directed air flow is therefore preferably so controlled by the control unit in the breaks in painting that the same amount of air is introduced into the painting booth in the breaks in painting as during a painting operation.

It should further be mentioned that different air flows can be introduced into the painting booth, namely on the one hand the air flow from the conventional filter ceiling and on the other hand the air flow from an additional nozzle arrangement. The air flow from the additional nozzle arrangement is preferably controllable and is preferably switched on only in breaks in painting. The additional nozzle arrangement is preferably branched from the air supply of the filter ceiling. This has the result that the delivery of compressed air from the additional nozzle arrangement leads to a correspondingly reduced delivery of compressed air from the filter ceiling. As a result, the overall air balance is thus substantially unchanged, that is to say the amount of air introduced into the painting booth remains at least approximately the same, so that undesired air flows in the painting booth are reduced or avoided completely.

In addition, the disclosure may provide that at least 70% of the total amount of falling air (i.e. of the downwardly directed air flow) should be introduced into the painting booth between two successive bodies (i.e. between the rear of the leading body and the front of the following body). This is expedient in order that the following body is not contaminated by the remaining overspray of the preceding body.

FIG. 1 shows an embodiment according to the disclosure of a painting booth 1 in a painting system for painting motor vehicle body components 2, the motor vehicle body components 2 being conveyed through the painting booth 1 on skids 4 by a conventional conveyor 3.

Painting of the motor vehicle body components 2 in the painting booth 1 is carried out by multi-axis application robots, which can be of conventional design and are not shown for the sake of simplicity.

It should further be mentioned that the painting booth 1 has a conventional filter ceiling which generates a largely laminar, downwardly directed air flow in the booth interior of the painting booth 1 for pushing overspray downwards in the painting booth and then feeding it through the booth floor, which is in the form of a grid, to a washing system, whereby the filter ceiling and the washing system can be of conventional design and are therefore likewise not shown.

The conveyor 3 conveys the motor vehicle body components 2 through the painting booth 1 in stop-and-go operation. This means that the motor vehicle body components 2 stop in the coating position shown in the drawing and are thus braked as they are conveyed in and accelerated as they are discharged. Acceleration of the motor vehicle body components 2 as they are discharged from the painting booth 1 is problematic in two respects.

Firstly, painting of the motor vehicle body components 2 produces overspray also in their interior, in particular when internal surfaces of the motor vehicle body components 2 are painted. This overspray in the interior of the motor vehicle body components 2 is shielded by the roof of the motor vehicle body components 2 from the downwardly directed air flow generated by the filter ceiling and therefore remains in the interior of the motor vehicle body components 2 for a relatively long time. When the motor vehicle body components 2 are discharged from the painting booth, the overspray then escapes from the motor vehicle body component 2 into the interior of the painting booth primarily in the backward direction through the tailgate, which can result in the next painting operation being impaired.

Secondly, the relatively abrupt acceleration of the motor vehicle body components 2 as they are discharged from the painting booth generates air turbulence in the booth interior, as a result of which the overspray can remain in the booth for longer.

For reducing the overspray from the booth interior of the painting booth 1 there is therefore additionally provided in this embodiment a manipulator 5 which is displaceable on a displacement rail 6 on the booth ceiling, parallel to the conveying direction 3, that is to say in the X-direction indicated by a double-headed arrow.

The manipulator 5 carries at its lower end a nozzle strip 7 which is oriented horizontally and at a right angle to the conveyor 3. The nozzle strip 7 has a large number of air nozzles distributed over its length, which air nozzles deliver an air jet 8 for reducing the overspray as quickly as possible from the booth interior of the painting booth 1.

The manipulator 5 allows the nozzle strip 7 to be raised or lowered in the vertical direction, that is to say in the Z-direction indicated by a double-headed arrow.

It should further be mentioned that the outlet direction of the air jet 8 is angled relative to the vertical by an angle $\alpha=15°-45°$ in the conveying direction of the conveyor 3. The air jet 8 thus blows away the overspray escaping from the tailgate of the discharged motor vehicle body component 2 obliquely forwards and downwards, so that the reduction of the overspray from the booth interior of the painting booth 1 can be accelerated.

As the motor vehicle body component 2 is discharged from the painting booth 1, the manipulator 5 with the nozzle strip 7 is displaced along the displacement axis 6 on the booth ceiling so that the distance between the nozzle strip 7 and the tailgate of the discharged motor vehicle body component 2 remains substantially constant during discharging. The manipulator 5 thus has a specific cleaning region which is located in front of the manipulator 5 in the conveying direction and in which the overspray is reduced particularly effectively. The movement of the manipulator 5 as the motor vehicle body component 2 is discharged is synchronised with the movement of the motor vehicle body component 2, so that the cleaning region of the manipulator 5 is always situated just behind the tailgate of the discharged motor vehicle body component 2, which contributes towards effective cleaning.

Figure 2A:
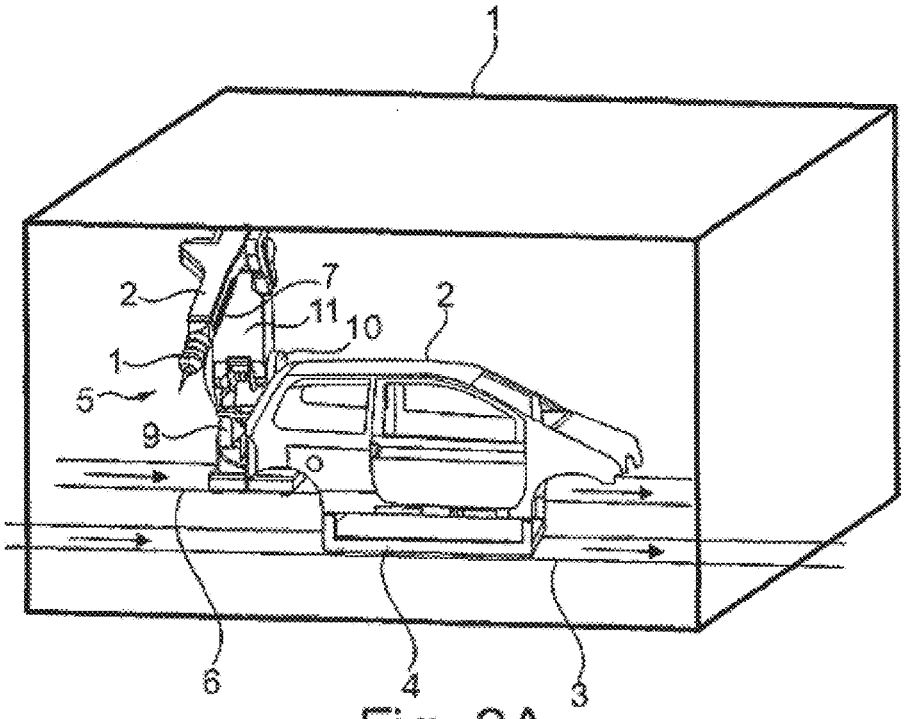
FIG. 2A is a simplified perspective view of another embodiment of a painting booth according to the disclosure having a modified handling robot for reducing the overspray.
Figure 2B:
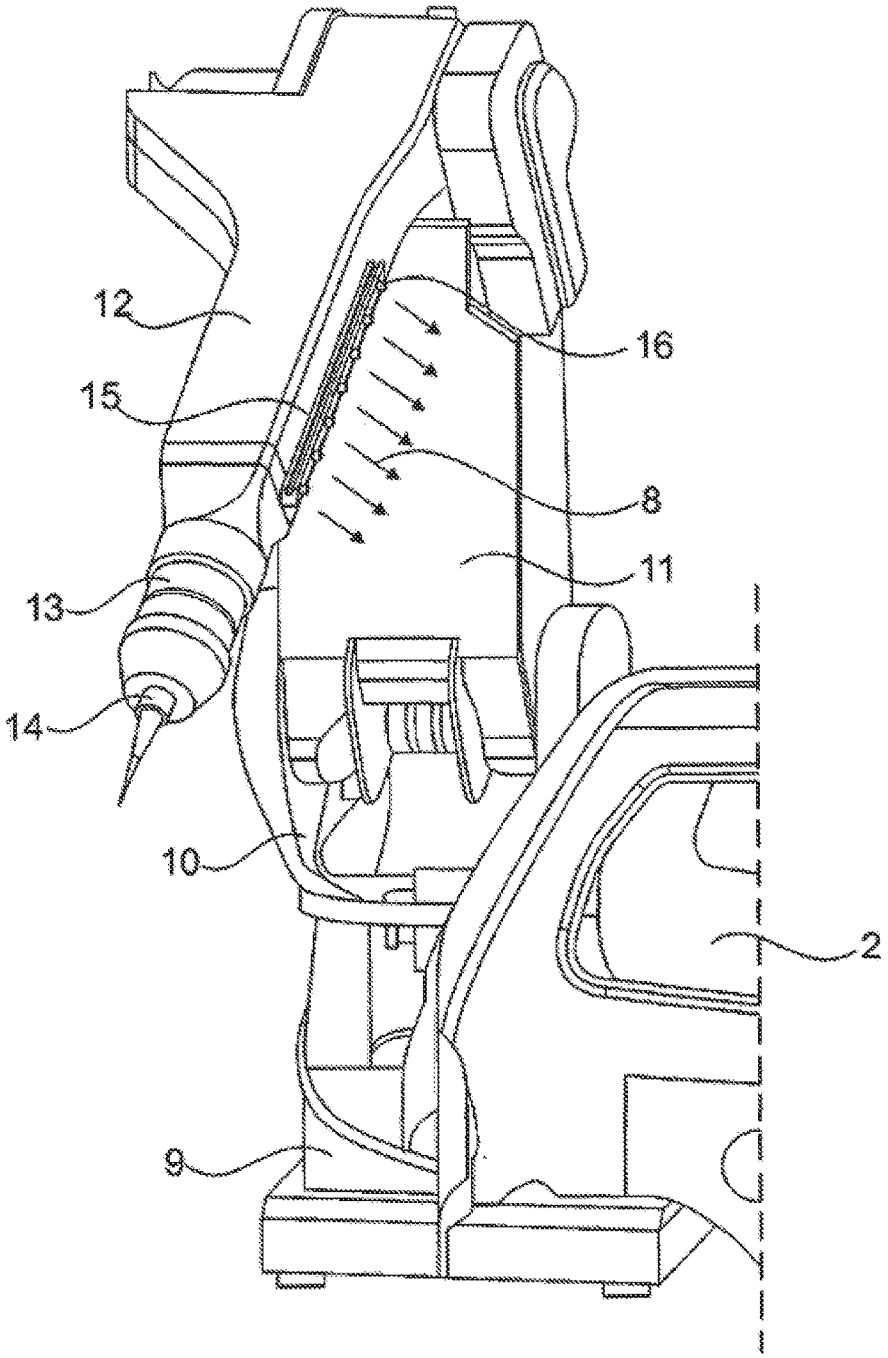
FIG. 2B is a large-scale perspective view of the modified handling robot.

FIGS. 2A and 2B show a modification of the embodiment according to FIG. 1 so that, in order to avoid repetition, reference is made to the preceding description, the same reference signs being used for corresponding details.

A particular feature of this embodiment is that the manipulator 5 for reducing the overspray from the interior of the painting booth 1 is a handling robot, the displacement rail 6 for displacement of the manipulator 5 being arranged on the booth floor laterally next to the conveyor 3.

The manipulator 5 is here in the form of a multi-axis articulated robot and has a robot base 9, a rotatable robot element 10, a proximal robot arm 11, a distal robot arm 12, a robot hand axis 13 and a handling tool 14. The construction of the manipulator 5 as a handling robot is known per se from the prior art and therefore does not have to be described in greater detail. However, the manipulator 5 is here modified by a nozzle strip 15 which is mounted on the distal robot arm 12 and extends in the longitudinal direction of the distal robot arm 12. The nozzle strip 15 has a plurality of air nozzles 16 which are distributed equidistantly along the length of the nozzle strip 15. The individual air nozzles 16 can each deliver an air jet 8, which is shown as an arrow for the purposes of the illustration. During the reduction of the coating agent, the proximal robot arm 12 having the nozzle strip 15 is oriented substantially horizontally and at a right angle to the conveying direction 3 and is arranged behind the tailgate of the motor vehicle body component 2 to be discharged. The individual air nozzles 16 then deliver the air jet 8 obliquely forwards and downwards, so that the overspray escaping from the motor vehicle body component 2 to be discharged is pushed away downwards, which contributes towards the rapid reduction of the overspray from the booth interior of the painting booth 1.

As the motor vehicle body component 2 is discharged from the booth interior of the painting booth 1, the manipulator 5 is then moved on the displacement rail 6 synchronously with the motor vehicle body component 2, which contributes towards a good cleaning action.

Figure 3:
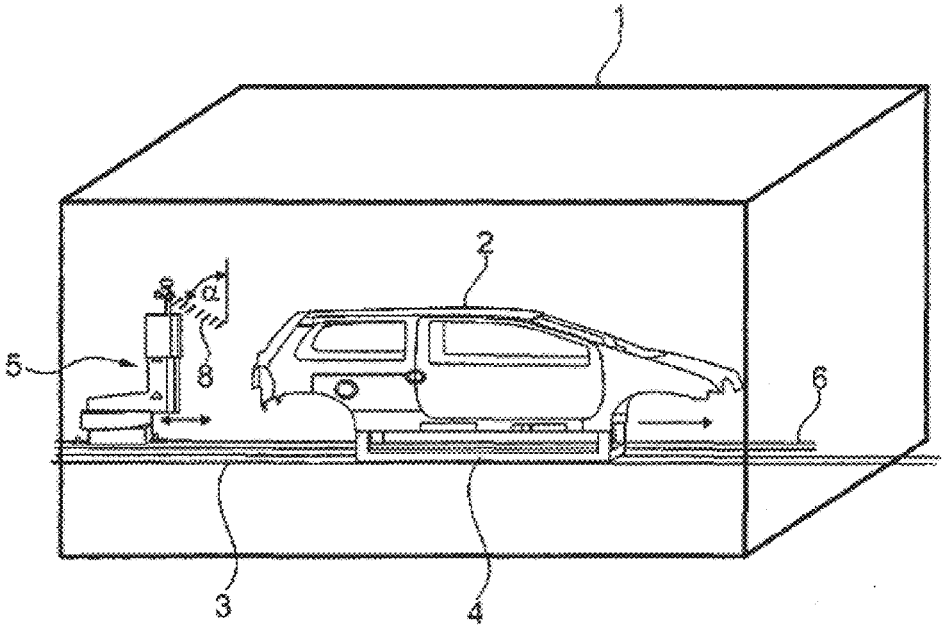
FIG. 3 is a simplified perspective view of a further embodiment of a painting booth according to the disclosure having a SCARA robot for reducing the overspray.

FIG. 3 shows a modification of the embodiment according to FIGS. 2A and 2B so that, in order to avoid repetition, reference is made to the preceding description, the same reference signs being used for corresponding details.

A particular feature of this embodiment is that the manipulator 5 is in the form of a SCARA robot (SCARA: selective compliance assembly robot arm).

Figure 4:
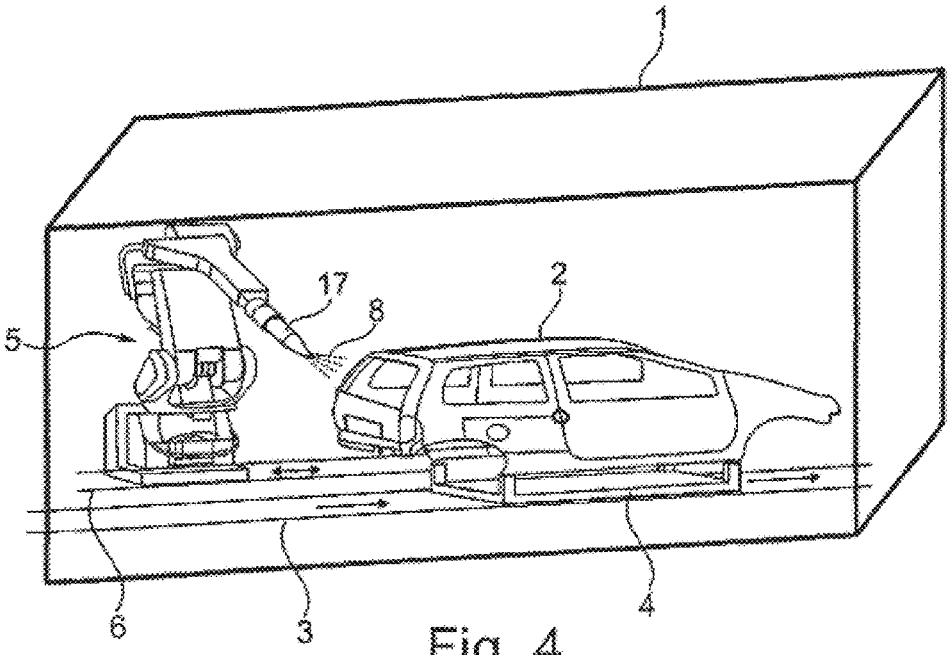
FIG. 4 is a simplified perspective view of a painting booth according to the disclosure, wherein a conventional application robot applies shaping air in order to reduce the overspray.

FIG. 4 shows a modification of the embodiment according to FIGS. 2A and 2B so that, in order to avoid repetition, reference is made to the preceding description, the same reference signs being used for corresponding details.

A particular feature of this embodiment is that the manipulator 5 for reducing the overspray is an application robot, which guides a rotary atomiser 17 having a shaping air ring as the applicator.

During application of the paint, the rotary atomiser 17 delivers a spray jet of the paint to be applied, the shaping air ring delivering shaping air for shaping the spray jet of the coating agent.

In order to reduce the overspray, the spray jet of the paint is then switched off and the rotary atomiser 17 only delivers shaping air via its shaping air nozzles, in order to push the overspray away.

Figure 5:
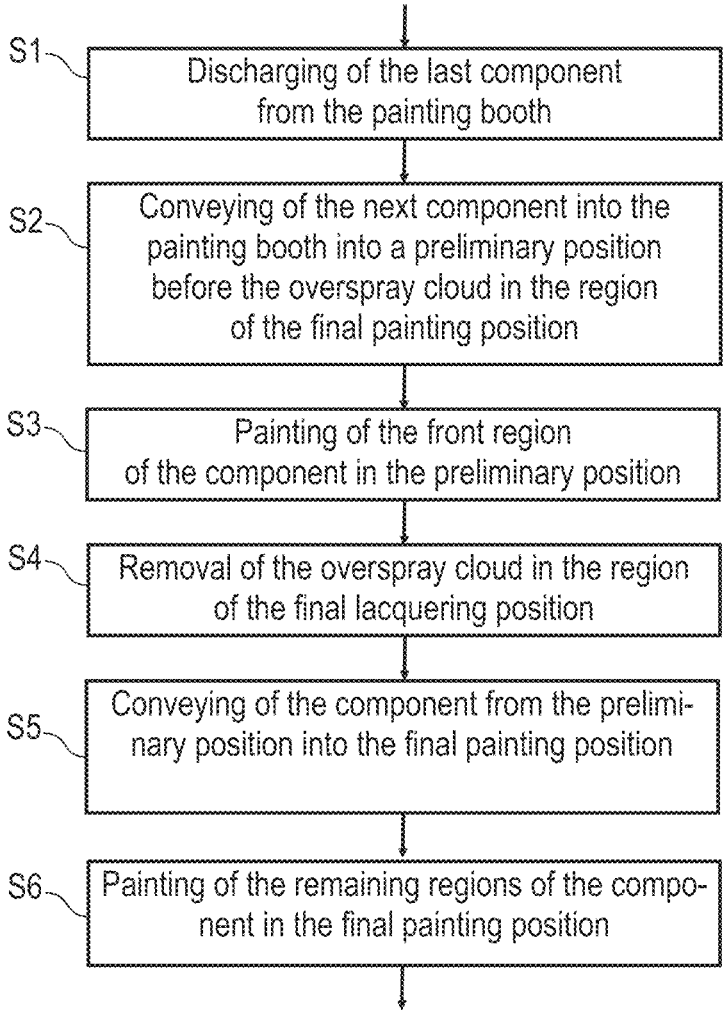
FIG. 5 is a flow diagram to illustrate a variant of the operating method according to the disclosure.
Figure 6A:
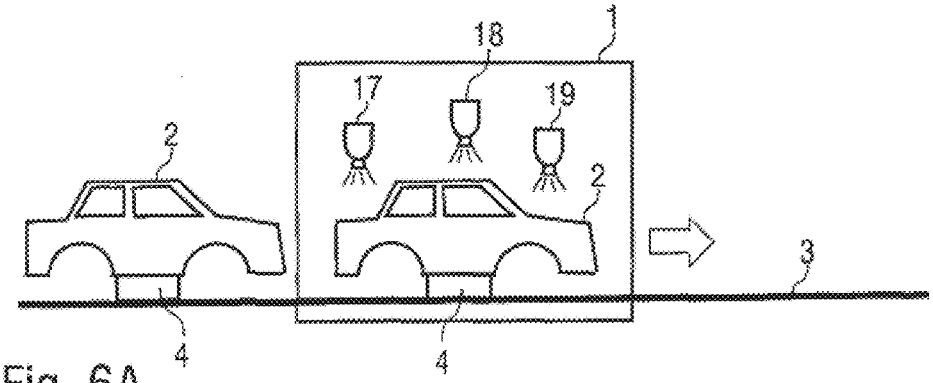
FIGS. 6A-6C show different stages of the conveying in or discharge of the motor vehicle body components in the operating method according to FIG. 5.
Figure 6B:
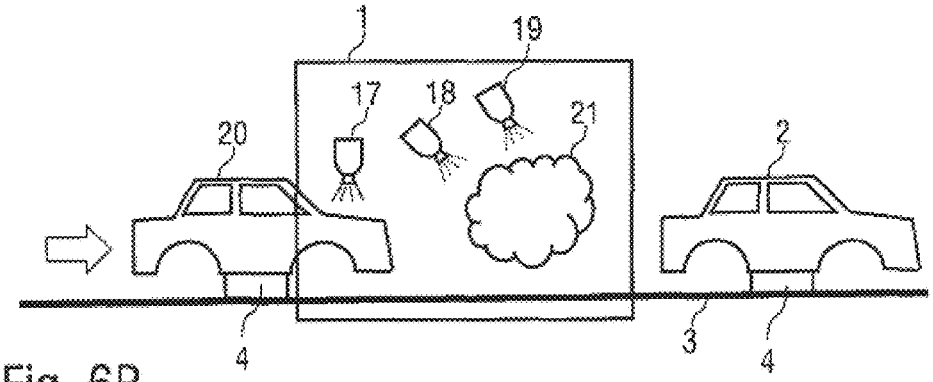
Figure 6C:
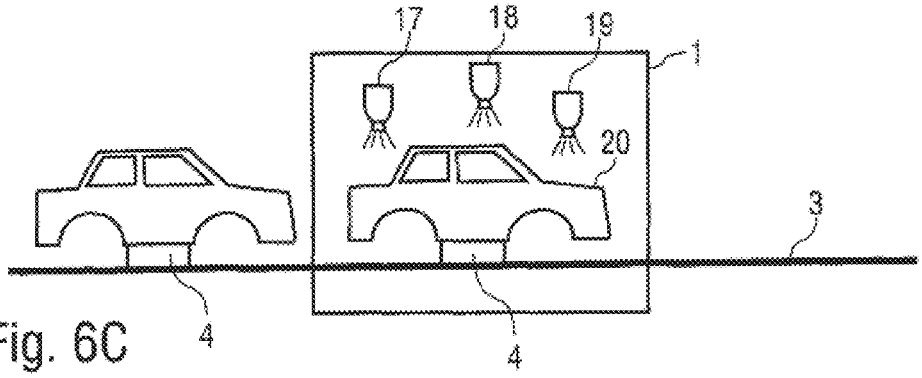

FIG. 5 shows a flow diagram for a variant of the operating method according to the disclosure, FIGS. 6A to 6C showing different stages during the operating method.

In FIGS. 6A-6C, spray jets of the coating agent are represented by solid lines, while air jets for reducing the overspray are shown as dotted lines.

FIG. 6A firstly shows a starting state in which the motor vehicle body component 2 is in the painting booth 1, where it is coated with paint by means of a plurality of rotary atomisers 17-19. The rotary atomisers 17-19 are guided in the conventional manner by multi-axis application robots, the application robots not being shown for the sake of simplicity. The motor vehicle body component 2 is here in a final coating position, in which the motor vehicle body component 2 can be coated completely. The next motor vehicle body component 2 which is subsequently to be painted is already waiting before the painting booth 1.

In a step S1, the motor vehicle body component 2 is then discharged from the painting booth 1 until the motor vehicle body component 2 is situated after the painting booth 1 in the conveying direction, as is shown in FIG. 6B.

In a step S2, the next motor vehicle body component 20 is conveyed into the painting booth 1. However, the motor vehicle body component 2 is initially not conveyed to the final coating position in the middle of the painting booth 1 but only to a preliminary position, which is shown in FIG. 6B.

In the preliminary position of the motor vehicle body component 20, a front region (e.g. engine bonnet, front wing) of the motor vehicle body component 20 is first painted in a step S3, for which purpose the rotary atomiser 17 is used.

The other two rotary atomisers 18, 19 then do not apply paint but deliver only compressed air via the shaping air nozzles, in order to reduce overspray 21 from the painting booth 1 in a step S4.

After the overspray 21 has been reduced, the motor vehicle body component 20 is then conveyed in a step S5 from the preliminary position according to FIG. 6B into the final painting position according to FIG. 6C.

In this final painting position, the component surface of the motor vehicle body component 20 is then painted in a step S6 in the remaining surface regions (e.g. boot lid, roof, doors, rear wing), for which purpose all the rotary atomisers 17-19 can be used.

Figure 7:
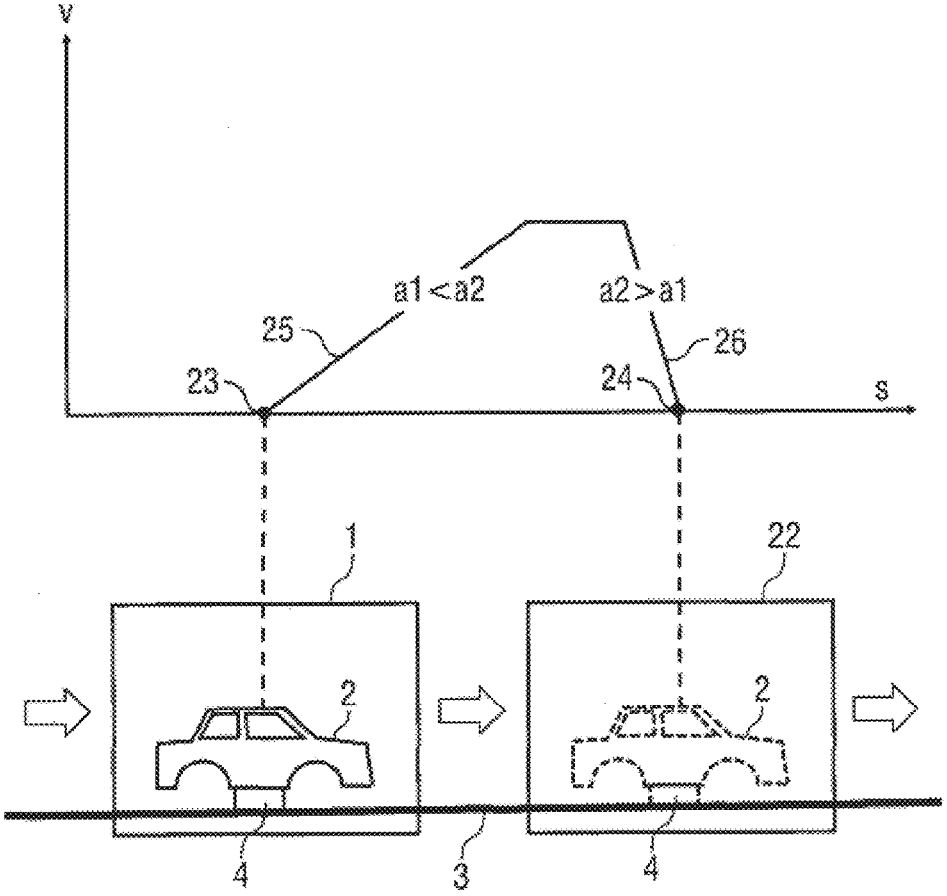
FIG. 7 is a diagram to illustrate the different accelerations during conveying into or discharging from the painting booth.

FIG. 7 shows a diagram to illustrate the acceleration of the motor vehicle body components 2 from the painting booth 1 to the immediately following painting booth 22. Between a stoppage point 23 in the painting booth 1 and the next stoppage point 24 in the painting booth 22, the motor vehicle body component 2 is first accelerated along an acceleration ramp 25 with an acceleration a1 and then decelerated along a deceleration ramp 26 with a deceleration a2.

It is clear from the diagram that the acceleration a1 on the acceleration ramp 25 is substantially less than the deceleration a2 on the deceleration ramp. The relatively small acceleration a1 is advantageous because less turbulence then occurs as the motor vehicle body component 2 is discharged from the painting booth 1, so that the overspray is then deposited or reduced more quickly.

Figure 8A:
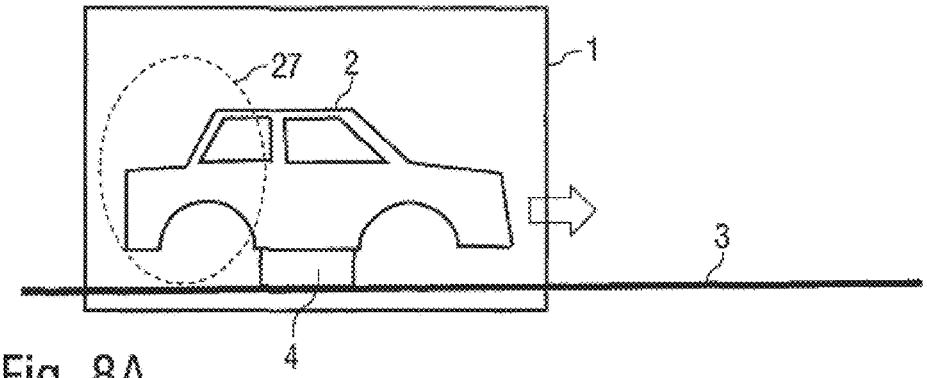
FIGS. 8A-8C show different stages of the discharging of a motor vehicle body from the painting booth.
Figure 8B:
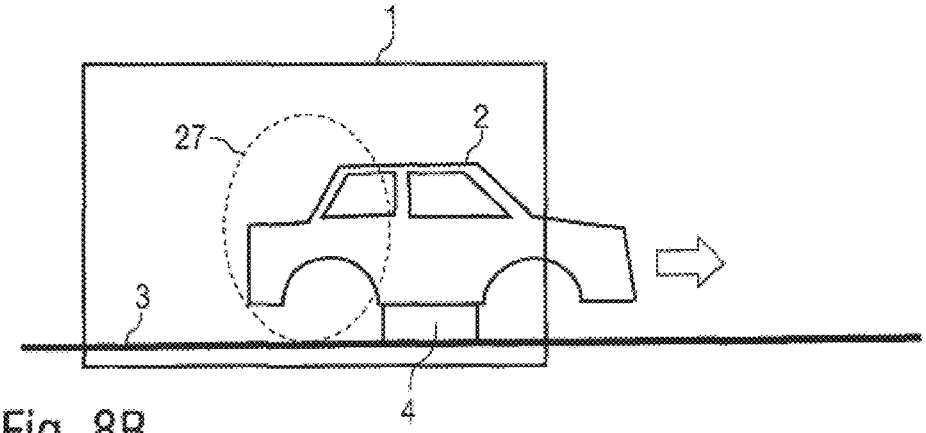
Figure 8C:
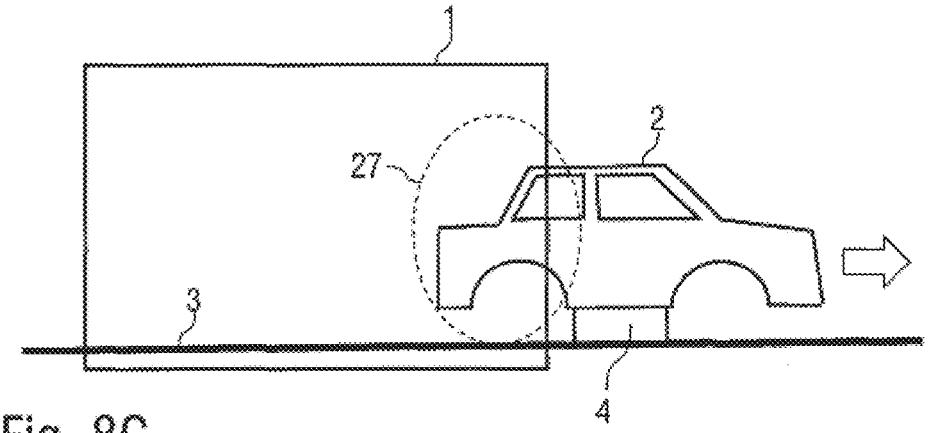

FIGS. 8A-8C show different stages during the discharge of the motor vehicle body component 2 from the painting booth 1, a cleaning region 27 being shown by a broken line. The cleaning region 27 is the region inside the painting booth 1 in which the air flow according to the disclosure leads to rapid reduction of the overspray. It is clear from the drawings that, as the motor vehicle body component 2 is discharged from the painting booth 1, the cleaning region 27 is moved synchronously with the discharged motor vehicle body component 2. This is advantageous because, as the motor vehicle body component 2 is discharged from the painting booth 1, the overspray is particularly intensive just behind the motor vehicle body component 2, since the overspray can there escape from the rear window of the motor vehicle body component 2.

Figure 9:
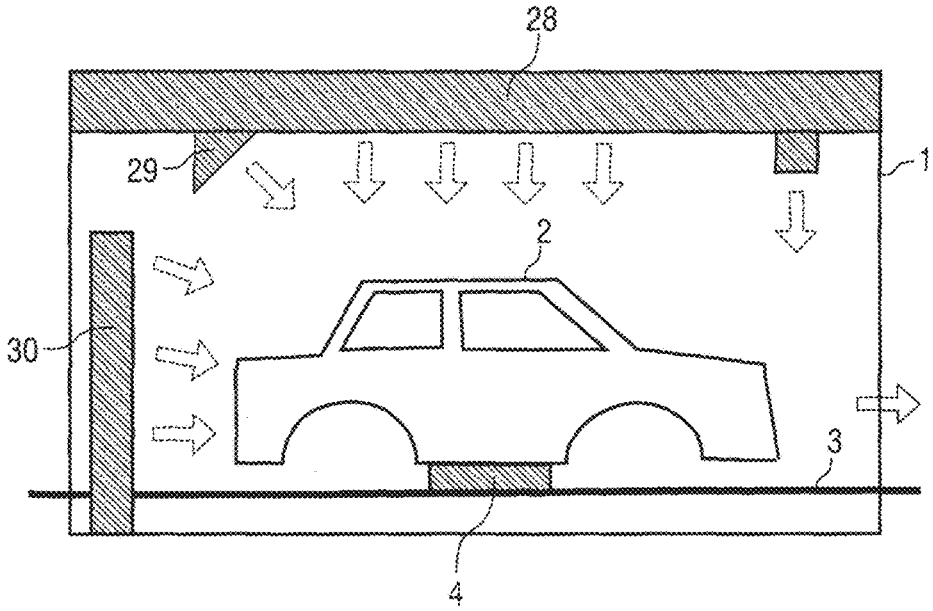
FIG. 9 is a schematic representation of a painting booth having a filter ceiling which delivers a downwardly directed air flow into the painting booth, wherein the air flow is angled in the conveying direction.

FIG. 9 shows a modification of a painting booth 1 according to the disclosure which coincides in part with the embodiments described above so that, in order to avoid repetition, reference is made to the preceding description, the same reference signs being used for corresponding details.

In this figure, a filter ceiling 28 is also shown, which can largely be of conventional construction and delivers a downwardly directed air stream into the painting booth 1 in order to push the overspray downwards.

The filter ceiling 28 has a nozzle element 29 which is arranged in the rear portion of the painting booth 1, relative to the conveying direction, and delivers the air stream obliquely forwards and downwards. The air stream leaving the nozzle element 29 is thus not oriented exactly vertically downwards but is inclined in the conveying direction, for example at an angle of 45° to the vertical. The overspray is thereby not only pushed downwards but is also blown away from the entrance to the painting booth 1. This substantially prevents the next motor vehicle body component 2 from being contaminated by the overspray from the preceding motor vehicle body component 2.

In addition, at the end of the painting booth 1 on the entrance side there is arranged a blowing column 30 which delivers an air stream into the painting booth in the conveying direction. The overspray is thereby likewise blown away from the entrance of the painting booth 1 in order to avoid contaminating the next motor vehicle body component 2.

The blowing column 30 has a plurality of air nozzles at different heights. As the height of the air nozzles increases, the air nozzles are angled more sharply downwards and thus deliver an air stream which is oriented more sharply downwards. The lowermost air nozzle of the blowing column 30 is thus oriented almost exactly horizontally, while the upper air nozzles are inclined more sharply downwards. This inclination of the upper air nozzles optimises the reduction of the overspray.

Figure 10A:
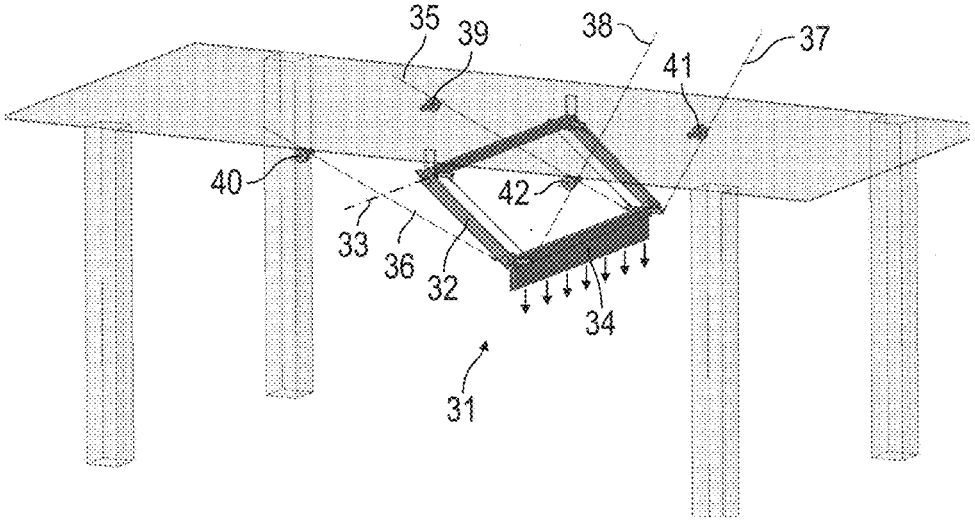
FIGS. 10A and 10B show two perspective views of a blowing nozzle arrangement having a pivotable frame, wherein the blowing nozzle arrangement delivers an air flow downwards in the painting booth for reducing the overspray.
Figure 10B:
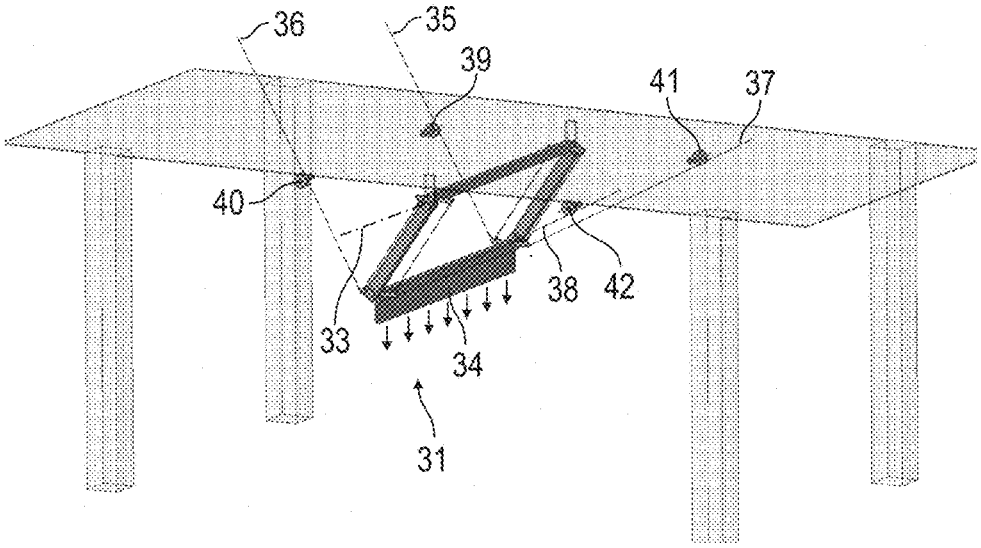

FIGS. 10A and 10B show different movement states of a blowing nozzle arrangement 31 according to the disclosure which can be used in a painting booth to deliver a downwardly directed air flow into the painting booth from top to bottom, in order to blow the overspray away downwards. The downwardly directed air flow is indicated in the drawings by arrows.

The blowing nozzle arrangement 31 has a pivotable frame 32 which is pivotable about an axis of rotation 33, the axis of rotation 33 extending through one frame edge of the frame 32.

On the opposite frame edge of the frame 32 there is mounted a slot-like blowing nozzle 34, which delivers the downwardly directed air flow. A lever construction ensures that the blowing nozzle 34 is substantially oriented downwards, independently of the movement position of the frame 32.

The pivoting movement of the frame 32 is driven by a cable drive, the cable drive having four pulling cables 35-38 and four rollers 39-42.

The air flow delivered by the blowing nozzle 34 pushes the overspray in the painting booth downwards through the grid floor of the painting booth, as has already been described in detail above.

Figure 11A:
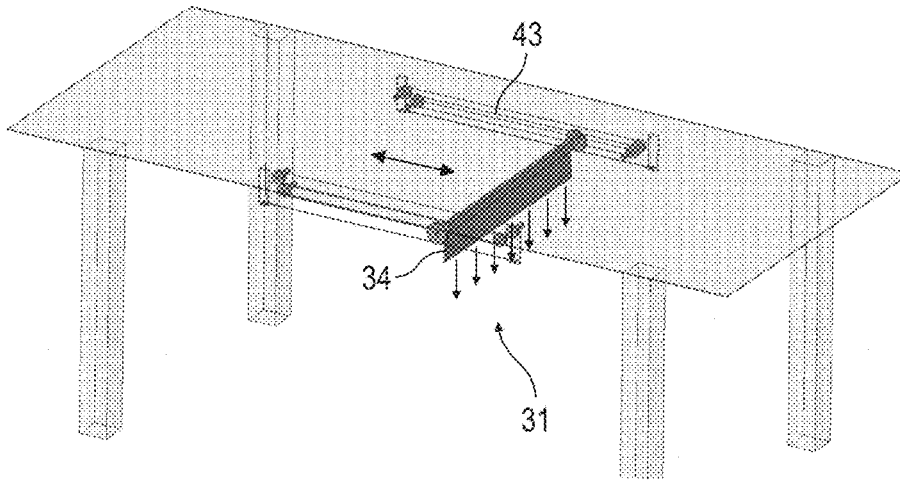
FIGS. 11A and 11B are perspective views of a modification of the blowing nozzle arrangement according to FIGS. 10A and 10B, wherein the blowing nozzle arrangement is linearly displaceable.
Figure 11B:
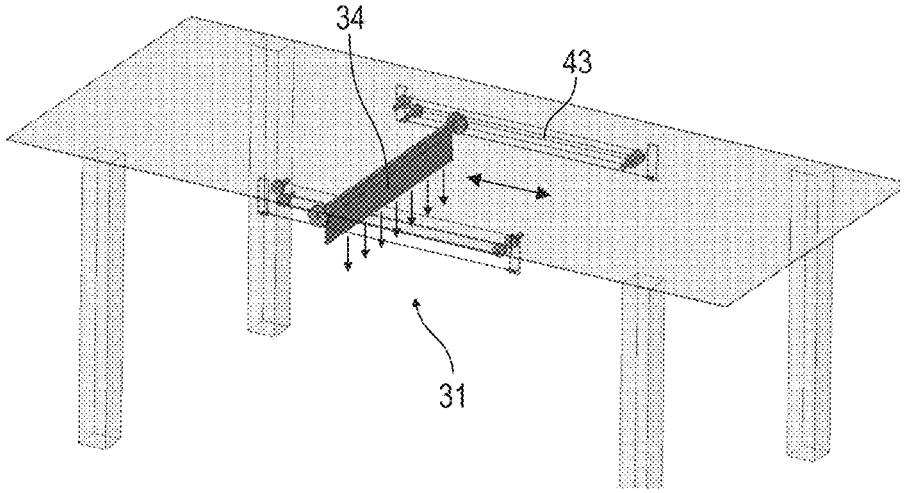

FIGS. 11A and 11B show a modification of the blowing nozzle arrangement 31 according to FIGS. 10A, 10B. This modification according to FIGS. 11A, 11B largely corresponds with the nozzle arrangement 31 according to FIGS. 10A, 10B so that, in order to avoid repetition, reference is made to the preceding description, the same reference signs being used for corresponding details.

A particular feature of this embodiment is that the blowing nozzle 34 is not pivotable but linearly displaceable, namely parallel to the conveying direction, the direction of displacement of the blowing nozzle 34 being indicated in the drawings by a double-headed arrow. Here too, movement of the blowing nozzle 34 is driven by a cable drive 43.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a movable manipulator having a plurality of movement axis; the cleaning device has a blowing nozzle arrangement which delivers the air flow downwards through at least one blowing nozzle in order to blow the troublesome overspray downwards out of the booth interior, and the movable manipulator is arranged above the conveyor, and the blowing nozzle arrangement extends through the coating booth transversely to the conveying direction.

2. The coating system according to claim 1, wherein for reducing the overspray from the booth interior the cleaning device generates in the booth interior a downwardly directed air flow which is spatially limited and does not include the entire booth interior.

3. The coating system according to claim 1, wherein the blowing nozzle arrangement is movable in the conveying direction.

4. The coating system according to claim 1, wherein a) the blowing nozzle arrangement is pivotable about an axis of rotation transversely to the conveying direction, and b) the blowing nozzle is at a distance from the axis of rotation so that the blowing nozzle executes a curved movement when the blowing nozzle arrangement performs a pivoting movement, and c) the blowing nozzle arrangement holds the blowing nozzle in a constant angular orientation relative to the vertical during a pivoting movement, so that the blowing nozzle delivers the air flow vertically downwards, and d) the blowing nozzle arrangement has a pivotable frame which is pivotable about the axis of rotation, the axis of rotation running through one frame edge while the blowing nozzle is mounted on the opposite frame edge.

5. The coating system according to claim 1, wherein the blowing nozzle arrangement has a linear displacement axis which runs parallel to the conveying direction, so that the blowing nozzle is displaceable in the conveying direction.

6. The coating system according to claim 1, wherein the manipulator for reducing the overspray is displaced in the conveying direction along a displacement rail.

7. The coating system according to claim 1, wherein the manipulator for reducing the overspray blows air into the booth interior in order to reduce the overspray from the booth interior.

8. The coating system according to claim 7, wherein the manipulator for reducing the overspray extracts the overspray from the booth interior by suction.

9. The coating system according to claim 1, wherein the manipulator for removing the overspray is suspended from a ceiling of the coating booth.

10. The coating system according to claim 1, wherein the manipulator for removing the overspray is mounted laterally on the coating booth.

11. The coating system according to claim 1, wherein the manipulator for reducing the overspray is a SCARA robot having parallel pivot axes.

12. The coating system according to claim 1, wherein the manipulator for reducing the overspray is a multi-axis application robot which also guides the applicator for applying the coating agent.

13. The coating system according to claim 12, wherein a) the applicator for blowing out shaping air has at least one shaping air nozzle for shaping the spray jet of the coating agent, and b) the applicator blows out the shaping air in order to remove the overspray from the booth interior.

14. The coating system according to claim 12, wherein the application robot has at least one separate air nozzle in addition to or instead of a shaping air nozzle in order to blow out air for reducing the overspray.

15. The coating system according to claim 1, wherein a) when the components to be coated are conveyed into the coating booth, they are first conveyed into a preliminary position in the coating booth which is situated upstream in the conveying direction of a final coating position in the coating booth, b) the overspray from a preceding coating operation is reduced in the region of the final coating position while the next component is in the preliminary position, c) the components to be coated are coated in the preliminary position only in their front region, for example on an engine bonnet or front wings, and d) the components are conveyed from the preliminary position into the final coating position when the overspray has been reduced in the region of the final coating position and the component in the preliminary position has been coated in the front region, and e) the components are then coated in the final coating position also outside the front region.

16. The coating system according to claim 1, wherein a) as one of the components is being discharged from the coating booth, overspray escapes from the component and/or is swirled up by the discharged component, and b) reduction of the overspray is spatially concentrated in a cleaning region which does not include the entire booth interior, c) the cleaning region includes at least a portion of the discharged component, d) as the component is discharged from the coating booth, the cleaning region is moved in the conveying direction synchronously with the component.

17. The coating system according to claim 1, wherein a) the components to be coated are conveyed through the coating booth in stop-and-go operation, and b) as the components to be coated are discharged from the coating booth, they are first accelerated with a specific acceleration and then braked again with a specific deceleration, and c) during discharge from the coating booth, the acceleration is lower than the following deceleration.

18. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling, e) the cleaning device having a blowing nozzle arrangement which delivers the air flow downwards through at least one blowing nozzle in order to blow the troublesome overspray downwards out of the booth interior, and f) the blowing nozzle arrangement is arranged above the conveyor, and g) the blowing nozzle arrangement extends through the coating booth transversely to the conveying direction wherein the blowing nozzle arrangement is movable in the conveying direction and wherein a cable drive is provided for moving the blowing nozzle arrangement.

19. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a manipulator and generates in the booth interior a downwardly directed air flow which is spatially limited and does not include the entire booth interior and wherein the manipulator is an articulated robot having non-parallel pivot axes.

20. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a manipulator and generates in the booth interior a downwardly directed air flow which is spatially limited and does not include the entire booth interior and wherein the manipulator is a handling robot.

21. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a movable manipulator and the cleaning device generates in the booth interior a downwardly directed air flow which is spatially limited and does not include the entire booth interior and wherein the manipulator is provided in addition to an application robot and/or a handling robot and is separate therefrom.

22. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a movable manipulator and wherein e) the manipulator guides at least one air nozzle in order to blow out air for removing the overspray, f) the manipulator has a proximal robot arm and a distal robot arm, the air nozzle for removing the overspray being mounted on the proximal robot arm and/or on the distal robot arm, and g) the manipulator has a nozzle strip having a plurality of air nozzles, and/ h) the nozzle strip is oriented substantially horizontally and transversely to the conveying direction, and i) the nozzle strip is arranged on the proximal robot arm and/or on the distal robot arm.

23. A Coating system for coating components, having:

a) a coating booth, b) a conveyor for conveying the components through the coating booth, c) at least one applicator inside the coating booth for applying a spray jet of a coating agent to the components to be coated, a portion of the applied coating agent being deposited on the components to be coated, while another portion of the applied coating agent floats in the booth interior as overspray, d) a cleaning device for reducing the overspray from the booth interior by an additional measure in addition to the reduction of the overspray by a vertically downwardly directed air flow that is generated by a filter ceiling wherein the cleaning device is on a movable manipulator and wherein e) the coating system has a control unit which controls the downwardly directed air flow, and f) the control unit switches on or increases the downwardly directed air flow in breaks in painting and switches off or decreases the downwardly directed air flow during a painting operation, and g) the control unit determines the quantity of air which is introduced into the painting booth during a painting operation, including:

g1) shaping air for shaping the spray jet, g2) driving air for driving a compressed air turbine of a rotary atomiser, g3) braking air for braking the compressed air turbine of the rotary atomiser, and/or g4) bearing air for supplying an air bearing of the rotary atomiser, and h) the control unit controls the downwardly directed air flow during a break in painting in such a manner that, during a break in painting, substantially the same quantity of air is introduced into the painting booth, via the downwardly directed air flow, as during a painting operation.

* * * * *